United States Patent [19]

Chica

[11] 4,165,826

[45] Aug. 28, 1979

[54] POP-UP HOLSTER

[75] Inventor: Quentin J. Chica, Springfield, Mass.

[73] Assignee: Bangor Punta Corporation, Springfield, Mass.

[21] Appl. No.: 886,765

[22] Filed: Mar. 15, 1978

[51] Int. Cl.[2] ..... F41B 13/04

[52] U.S. Cl. ..... 224/191; 224/901; 2/DIG. 6; 224/911

[58] Field of Search ..... 224/2 B, 2 C, 1 R, 2 R, 224/5 R, 5 B, 5 H, 4 E, 26 R, 26 B, 26 C, 26 D, 26 K; 2/DIG. 6, 312, 338; 24/DIG. 18, 3 R, 3 M, 81 R

[56] References Cited

U.S. PATENT DOCUMENTS

| | | | |
|---|---|---|---|
| 1,844,603 | 2/1932 | Sarson | 224/2 B |
| 3,383,738 | 5/1968 | Fox et al. | 2/DIG. 6 |
| 3,664,560 | 5/1972 | Perkins | 224/26 R |
| 4,022,361 | 5/1977 | Devlin | 224/26 R |

*Primary Examiner*—Robert J. Spar
*Assistant Examiner*—Kenneth W. Noland
*Attorney, Agent, or Firm*—LeBlanc & Shur

[57] ABSTRACT

A holster and a belt for carrying a handgun where the holster is releasably secured to the belt for locating the handgun within trousers to maintain the handgun sufficiently hidden until exposed for use. The holster has a pocket member for receiving the handgun and a flexible portion which connects the holster to the belt. This flexible portion is of a length which locates the entire handgun where it is carried by the pocket portion of the holster below the belt such that it will be normally hidden from view. To expose the handgun for operation, the operator can simply press the holster, upwardly exposing at least a grip of the handgun for grasping by the user.

6 Claims, 5 Drawing Figures

FIG. 1
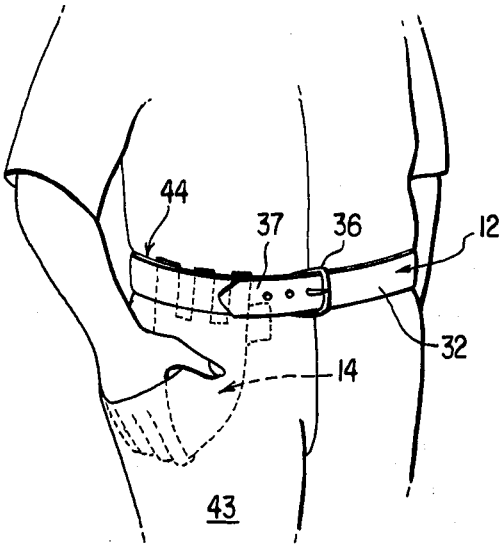
FIG. 2
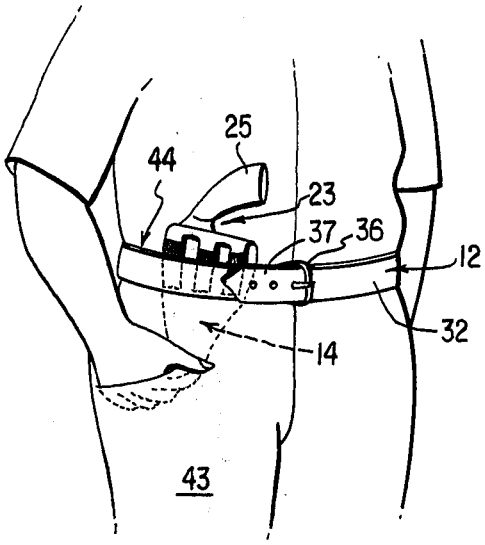
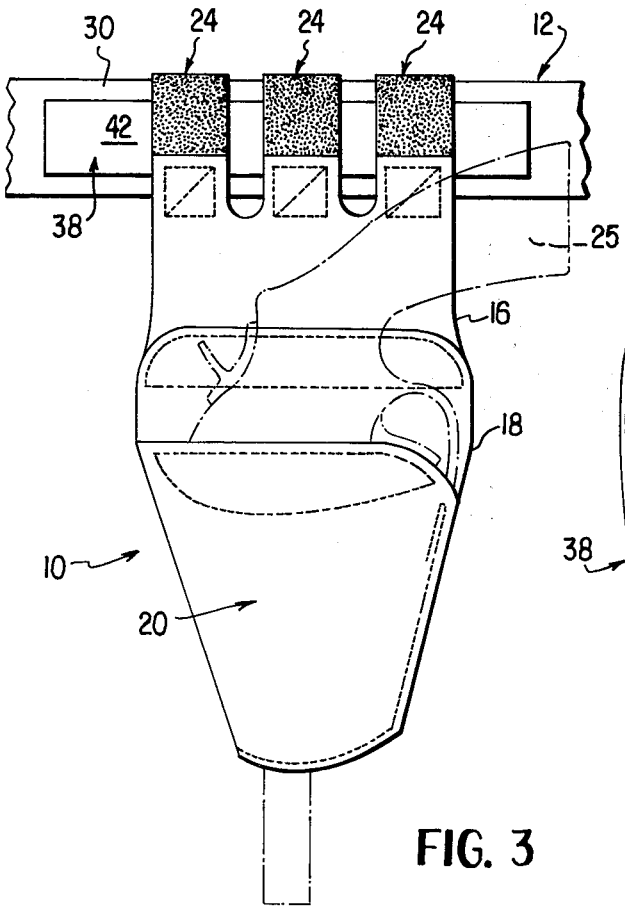
FIG. 3
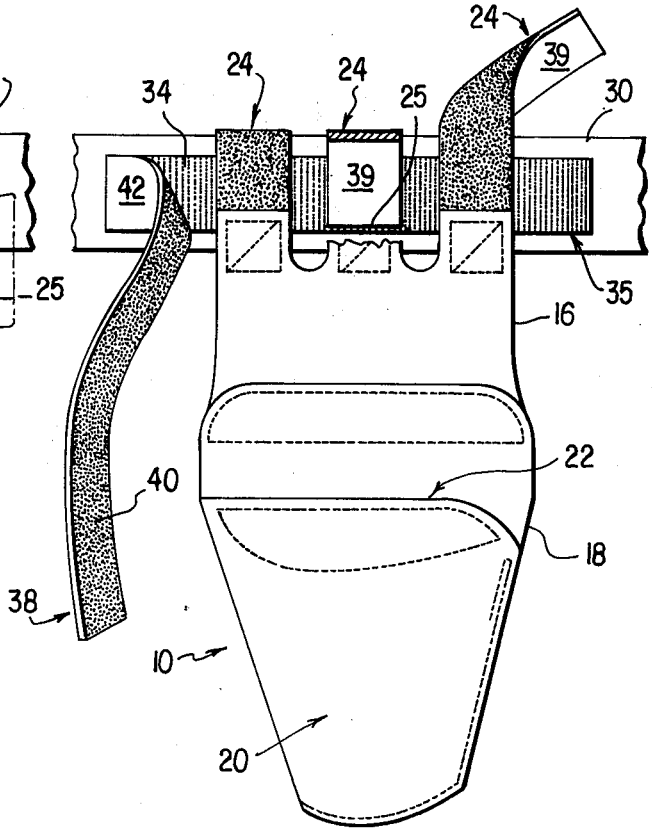
FIG. 4

POP-UP HOLSTER

BACKGROUND OF THE INVENTION

Holsters for holding handguns have been provided with belts, straps and similar securing means to locate the holsters on various portions of the body and to keep them hidden from view until access is desired by the user. An example of this is a shoulder holster where the holster itself is located adjacent the underarm to maintain it hidden from view when a sport coat or the like is worn. However, rather apparent motions and gestures are required by the user to reach into the under portion of a sport coat to grasp the handgun carried by the shoulder holster. As a result, these gestures defeat the very purpose of having a weapon hidden from view in that once the motion is started, it is well known to the observer what is being done.

In addition, once the jacket or sport coat is removed, the holster and gun are in full view of those in the vicinity of the person wearing this type of apparatus. This impedes the use of such shoulder holsters or other similar holsters where it is desirable to have a hidden weapon, particularly when the user will be operating in locations which would not require the kind of cover supplied by a sport coat or jacket. The rather elaborate securing means of belts and straps required serve little or no other purpose than holding the holster at a desired position. Thus, the appearance of such straps and belts immediately give notice of their use.

It is an object of the invention described hereinafter to overcome many of the problems that have plagued holsters which are desired to be hidden from view which have heretofore existed.

More particularly, it is an object of the invention to provide a holster which is secured to a belt which is typically worn by a user in the belt loops adjacent the top of trousers and allows the holster to be carried secured to the belt within the trousers completely hidden from view until it is desired to use the weapon where the holster can be moved upwardly for exposing at least the grip of a handgun carried by the holster.

It is also an object of the invention to provide a releasable securing means in connection with a holster and a belt such that the holster can be completely removed from the belt allowing the belt to be used in this normal manner with trousers and the like.

These and other objects will become more apparent from the description of the preferred embodiment and claims which follow hereinafter.

BRIEF DESCRIPTION OF THE DRAWINGS

FIG. 1 shows the holster in a hidden disposition.

FIG. 2 shows the holster in an exposed disposition.

FIG. 3 is an elevation of the holster secured to a belt.

FIG. 4 shows portions of the securing means of the holster in FIG. 3 peeled away.

DETAILED DESCRIPTION OF THE PREFERRED EMBODIMENT

Figure 5:
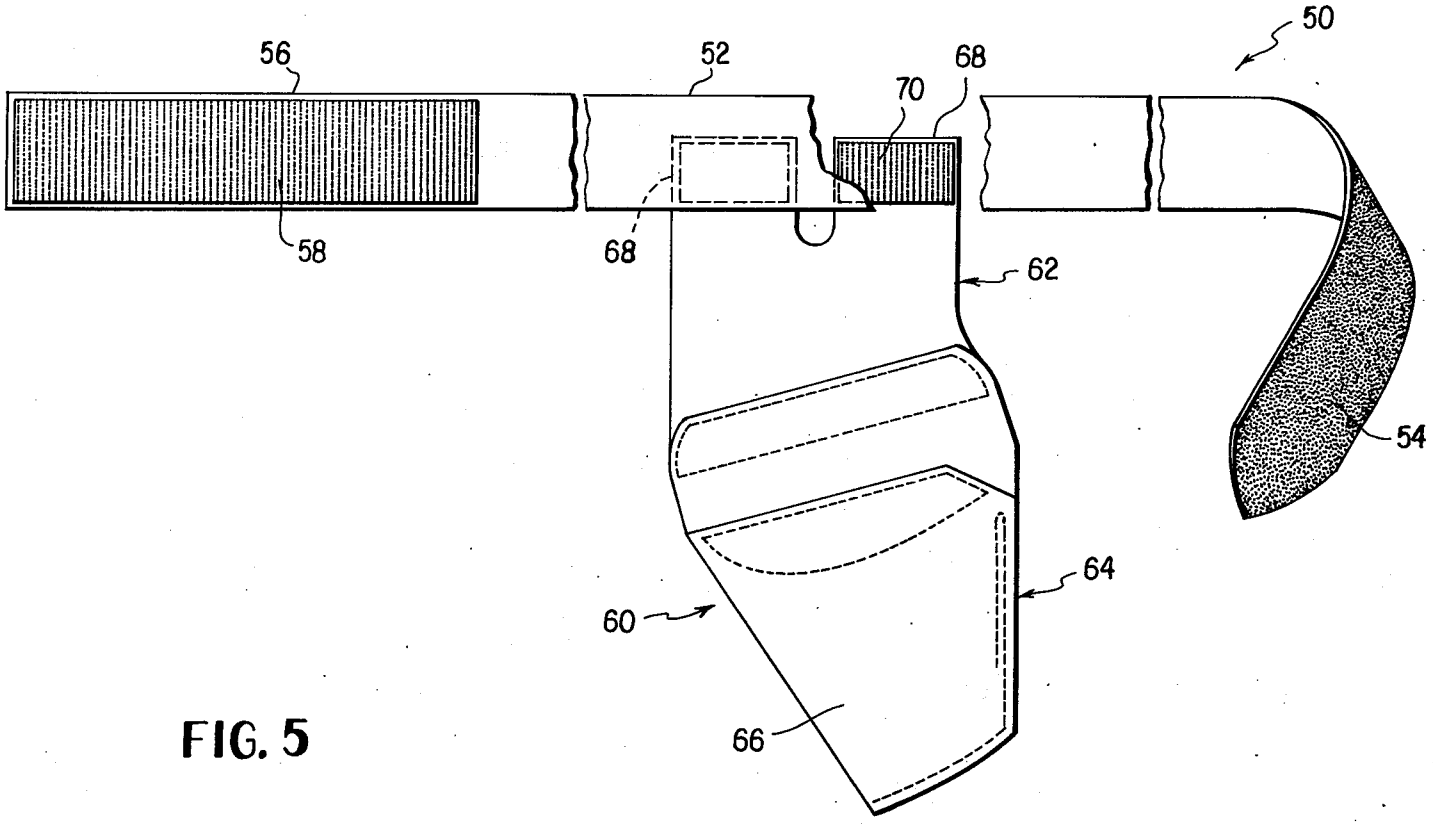
FIG. 5 shows another embodiment of the holster.

In referring to FIGS. 1, 2, 3, and 4, it can be seen that the inventive holster 10 is used in conjunction with a waist belt 12 to secure the holster underneath the top portions of trousers adjacent the pocket such that the holster with the handgun will be totally hidden from view.

More particularly, the holster 10 includes a back side 14 having an upper portion 16 and a lower portion 18. A pocket 20 is carried by the lower portion 18 and has an open top 22 for receiving a handgun 23 with the grip 25 extending forwardly when the holster is worn as shown in FIGS. 1 and 2. Extending from the upper portion 16 are three equally spaced strips 24 parallel to one another, each having one part of a securing means attached to the end of each strip 24 providing a means for securing the holster to the belt 12. In this preferred embodiment, a complementary part of the securing means is attached to the belt. The securing means is a hook and loop fastener sold under the trademark "Velcro". The part of the fastener attached to the strips 24 is "Velcro" pile patches 28 sewn to the top of each strip 24, and the complementary "Velcro" hook material 34 is attached to the belt 12.

The belt 12 defines an inner surface 30 and an outer surface 32 which is exposed for view by the public when the belt is worn by the user. The inner surface 30 carries the complementary "Velcro" hook material 34 for cooperating with the Velcro pile patches 28 carried by the strips 24 such that when the pile is pressed against the hooks, the holster will be secured to the belt.

In the embodiment described herein, the "Velcro" hook material 34 is carried on a flexible strip 35 of one-inch width and six-inch length, which is glued to the inner surface 30 of the belt 12. The "Velcro" pile patches 28 carried by the strips 24 are one inch wide and approximately three inches in length.

The belt 12 is the standard type including buckle 36 and a tongue 37 for securing the belt in place. A second flexible strip 38 has one side 42 which is smooth and another side 40 which is comprised of "Velcro" pile material for cooperating with the exposed hook material 34 of the "Velcro" fastener to further secure the holster 10 in place. It should be noted that the second flexible strip 38 also has dimensions of a width of one inch and a length of six inches such that it will completely cover exposed "Velcro" material carried by the belt 12. In this way, when the belt is worn with or without the holster, the "Velcro" material secured to the inner surface 30 of the belt will never become secured to any part of the trousers where the belt is worn because only the smooth surface 42 of the second strip 38 is exposed to the vicinity of the trousers engaged by the waist belt 12.

The upper portion 16, including the strips 24, has a length to allow the holster 10 to fall well below trouser top 44 of trousers 43. For this purpose, it is desirable to secure the ends of strips 24 adjacent the bottom edge of flexible strip 35 to obtain full extension of the holster 10 as well as substantial engagement between each part of the "Velcro+ fastener. The second strip 38 in then placed over the strips 24 and pressed against the remaining exposed hook material 34 of strip 35 to reinforce securing of the strips 24 to the belt 12. The holster 10 is then looped back over the strip 38 so that the backside 39 of strips 24 are in opposing facing relationship with the smooth surface 42 of strip 38 as can be seen in FIGS. 3 and 4.

The trousers 43 on which the belt is worn as shown in FIGS. 1 and 2 include the trouser top 44 and a trouser pocket near the front of the trousers 48. The holster 10 and securing means are located on the belt 12 adjacent the buckle 36 so that the holster will be located in the vicinity of the trouser pocket 48 as shown. The upper portion 16, including the strips 24, having a length such that the strips 24 are looped over the top 44 of the trousers 43 allowing the holster to fall well within the trousers 43 adjacent the pocket 14 such that not portion of the gun, including the grip 25, is exposed to view. In this preferred embodiment, the length is such that the end of the grip is approximately on inch from the top of the trousers 43.

With the above-described configuration, the holster can be very quickly secured to the belt by simply pressing the parts of the "Velcro" material together. The weapon is then placed in the holster and allowed to drop to the appropriate position within the trousers by looping the upper portion of the holster over the top of the trousers. In this position, the holster with the weapon are completely hidden from view; nor is there any suspicion created by the waist belt to which the holster is secured, since the outer surface of the belt is of a standard waist belt configuration. When it is desired to use the weapon, the user can simply place his hand in his pocket pressing the holster upwardly exposing the grip as shown in FIG. 2. The holster can be readily moved upwardly because of the flexible upper portion allowing it to flex sufficiently so that the holster with the weapon can be moved upwardly as shown. In addition, when it is not necessary to wear the holster, it can simply be removed by peeling off the "Velcro" material and replacing the second flexible strip if desired to prevent inadvertent securing which may otherwise occur between the "Velcro" material on the belt portions of the trousers on which the belt is worn.

Another embodiment is shown in FIG. 5 for locating a holster in a hidden disposition within trousers or the like. In this embodiment, the holster and belt assembly 50 can be located entirely within the trousers without the need to rely on a standard type belt typically worn on the outside of the trousers or pants. For this purpose, the belt 51 employed is flexible throughout its length and carries portions of a "Velcro" fastener to secure the belt 52 about the wearer. The outer side of the belt 52 is comprised entirely of "Velcro" pile 54. The inner side of the belt 52 is substantially smooth except for one end 56 which carries "Velcro" hook material 58. This allows the belt 52 to be worn by simply wrapping the belt 52 about the midsection and pressing the hook material 58 into engagement with the pile 54. This type of fastening mechanism avoids any substantial bulge in the trousers which might normally accompany a larger metal buckle.

In addition, the "Velcro" pile 54 allows the holster to be attached anywhere along its length for locating the holster properly relative to a pocket in the trousers. The holster 60 includes an upper flexible portion 62 which carries means for attaching the holster to the belt 52 and a lower portion 64 which carries pocket 66 for receiving the handgun. The upper portion 62 further defines two strips 68 each having its respective path of "Velcro" hook material 70 secured thereto. It should be noted that the hook material 70 is secured to the same side of the holster 60 as the pocket 66. With this configuration, the holster 60 is secured to the belt 52 by simply pressing the hook material 70 into engagement with the pile material 54. When worn, the holster 60 can hang from the belt 52 as shown in FIG. 5 or be looped back in a manner similar to that shown in FIGS. 3 and 4. This latter approach is more efficient in ensuring that the handgun carried in the pocket 66 will easily move upwardly when pushed by the user. Of course, if the belt 52 is worn beneath the trousers, no part of the trousers will extend between the upper portion 62 and the belt 52 in the manner described with respect to FIGS. 3 and 4. However, the holster and belt assembly 50 could be worn in a manner similar to that of the earlier embodiment described above.

The invention may be embodied in other specific forms without departing from the spirit or central characteristics thereof. The present embodiment is, therefore, to be considered in all respects as illustrative and not restrictive, the scope of the invention being indicated by the appended claims rather than by the foregoing description, and all changes which come within the meaning and range of requivalency of the claims are, therefore, intended to be embraced herein.

What is claimed and desired to be secured by United States Letters Patent is:

1. A holster for use with a waist belt for carrying a handgun comprising:

(a) said holster having a side member with an upper portion and a lower portion;

(b) said lower portion having a pocket portion extending from the side member with an open top for receiving and holding said handgun;

(c) said upper portion of said side member being secured to said belt, said upper portion further including a flexible member of a length to maintain said handgun below said belt when said holster is secured to said belt, and said length, when said belt is worn on the top part of trousers, allowing said upper portion to be looped over said top of said trousers whereby the holster with the handgun being carried in the pocket of said holster is completely hidden from view within said trousers while said holster is being secured to said waist belt;

(d) said flexible member including at least two spaced apart plastic strips extending upwardly substantially parallel to one another each of said two strips carrying a first part of a releasable securing means, an inside surface of said waist belt having a second complementary part of said securing means for cooperating with said first part carried by said flexible means to secure said holster to said waist belt, said first part and said second complementary part being respective parts of hook and loop fasteners whereby said handgun located within said pocket is movable between a normally hidden position where said handgun is hidden below said waist belt and where movement of said holster upwardly allows flexing of said flexible member to expose at least a grip of said handgun for grasping by the user;

(e) a third flexible strip having a first side and a second side, said first side being substantially smooth and said second side carrying a part of either hook or loop fasteners for securing said third strip to said belt, and when said third strip is disconnected from said belt it exposes portions of said second complementary part, said third strip overlaying said two spaced apart strips of said flexible upper portion of said holster to further secure said holster to said waist belt.

2. The holster according to claim 1 wherein said third strip includes length and width dimensions substantially identical to those of said complementary member carried by said inner surface of said belt whereby said trousers in the vicinity of said belt are prevented from contact with any portions of said hook and loop fasteners.

3. The holster according to claim 2 where in said second complementary part is glued to said belt and said first part is sewn to said two spaced-apart strips and said third strip with said part of either said hook or loop fasteners being separate from said belt and said spaced-apart strips.

4. The holster according to claim 3 wherein said belt has a buckle for securing the belt about the user adjacent the top of the trousers, said second complementary part being located adjacent said buckle and said upper portion having a length for locating said holster when secured to said belt adjacent a front pocket of said trousers allowing the user to insert his hand into the pocket to push the holster upwardly for exposing the grip on the handgun carried by said holster for grasping by the user.

5. The holster according to claim 4 where said second complementary part is the hook part of said hook and loop fasteners and said first part includes the loop part of said hook and loop fasteners and said part carried by said third strip including the loop part of said hook or loop fasteners such that when the loop part of said first part is pressed into engagement with said hook part of said second complementary part said spaced-apart strips will be secured to said waist belt.

6. A holster and belt combination, said belt supporting said holster, said holster receiving a handgun and said holster and handgun being located inside and below the top of trousers on which the belt is worn, said holster and handgun being positioned adjacent a trouser pocket so that said handgun can be moved from a hidden position below the top of said trousers to an exposed position above the top of said trousers, such movement occurs by inserting a hand into the trouser pocket and pushing the holster upwardly, said combination comprising:

a said holster having a pocket adapted to receive a handgun having an upper opening for admitting and withdrawing said handgun from said pocket and a backside and a frontside, an upper edge of said backside extending above an upper edge of said frontside;

a flexible flap member having a lower edge attached to the upper edge of the backside of said pocket, an upper portion of said flap member forming at least two strips;

a belt having an outer and an inner surface adapted to be worn encircling trousers adjacent the top thereof;

a first hook and loop fastener means for securing the ends of said belt including a strip of a hook part of said means mounted on the inner surface of said belt adjacent one end thereof and at least a strip of a loop part of said means mounted on the outer surface of said belt adjacent the end thereof opposite the end mounting said hook part so that ends of said belt may be secured by pressing said hook and loop parts together;

a second hook and loop fastener means for connecting distal portions of said two strips to said belt, each of the distal portions mounting the hook part of said second fastener means and said belt mounting the loop part of said second fastener means so that the distal portions of said strips may be secured to said belt by pressing the hook and loop parts together of said second fastener means;

said flexible flap member and two strips being sufficiently elongated to extend upwardly from said belt and said two strips extend over the top of said trousers, and said flexible flap member and said two strips extend downwardly within said trousers so that said holster pocket and handgun received therein will be entirely concealed below the top of said trousers and whereby when said holster pocket is urged upwardly and flexible flap member will flex exposing at least the upper opening of said pocket at the top of said trousers so that said handgun may be withdrawn from said pocket or admitted thereto.

* * * * *